US006539870B1

(12) United States Patent
Granholm

(10) Patent No.: US 6,539,870 B1
(45) Date of Patent: Apr. 1, 2003

(54) BLASTING METHOD FOR REDUCING NITROGEN OXIDE FUMES

(75) Inventor: Richard H. Granholm, Sandy, UT (US)

(73) Assignee: Dyno Nobel Inc., Salt Lake City, UT (US)

( * ) Notice: Subject to any disclaimer, the term of this patent is extended or adjusted under 35 U.S.C. 154(b) by 58 days.

(21) Appl. No.: 09/717,271

(22) Filed: Nov. 22, 2000

(51) Int. Cl.[7] ..... F42B 3/00
(52) U.S. Cl. ..... 102/313; 149/46; 149/108.4
(58) Field of Search ..... 149/46, 108.4; 102/313

(56) References Cited

U.S. PATENT DOCUMENTS

| | | | | | |
|---|---|---|---|---|---|
| 3,610,150 | A | * | 10/1971 | Teichmann | 102/313 |
| 3,618,520 | A | * | 11/1971 | Hamasaki et al. | 102/313 |
| 3,653,992 | A | | 4/1972 | Fee et al. | |
| 3,683,809 | A | * | 8/1972 | Burkle | 102/332 |
| 4,026,738 | A | | 5/1977 | Richard | |
| 4,161,142 | A | * | 7/1979 | Edwards et al. | 102/312 |
| 4,256,521 | A | | 3/1981 | Scherzinger | |
| 4,357,184 | A | | 11/1982 | Binet et al. | |
| 4,439,254 | A | | 3/1984 | Mullay | |
| 4,844,756 | A | | 7/1989 | Forsberg | |
| 4,919,178 | A | | 4/1990 | Riga et al. | |
| RE33,788 | E | * | 1/1992 | Clay | 149/2 |
| 5,608,185 | A | * | 3/1997 | Granholm et al. | 102/332 |
| 5,859,383 | A | * | 1/1999 | Davison et al. | 102/307 |
| 5,920,030 | A | * | 7/1999 | Day | 102/313 |
| 5,920,031 | A | | 7/1999 | Jahnke | |

FOREIGN PATENT DOCUMENTS

| | | |
|---|---|---|
| CA | 1244244 | 11/1988 |

* cited by examiner

*Primary Examiner*—Edward A. Miller

(57) ABSTRACT

The present invention is directed to an improved method of blasting whereby the formation of nitrogen oxide after-blast fumes is reduced. This helps satisfy the need for better fume characteristics in blasting. The method reduces the formation of nitrogen oxides in after-blast fumes resulting from the detonation of a blasting agent in a borehole. The method comprises formulating the blasting agent to contain from about 1% to about 20% silicon powder.

9 Claims, No Drawings

BLASTING METHOD FOR REDUCING NITROGEN OXIDE FUMES

The present invention relates to an improved method of blasting with blasting agents. More particularly, the invention relates to a method of reducing the formation of toxic nitrogen oxides ($NO_x$) in after-blast fumes by using a blasting agent that contains particulate silicon metal (hereafter silicon powder).

The blasting agent used in the method of the present invention can be of the ANFO type, a water-in-oil emulsion or a water gel. In addition, the emulsion or water-gel can contain significant amounts of ammonium nitrate (AN) or ammonium nitrate-fuel oil (generally in a ratio by weight of 94:6) prills (ANFO). The water-in-oil emulsion (hereafter emulsion) comprises a water-immiscible organic fuel as a continuous phase, an emulsified inorganic oxidizer salt solution as a discontinuous phase, an emulsifier, gas bubbles or an air entraining agent for sensitization, and silicon powder in an amount from about 1% to about 20% by weight of the composition for reducing the amount of nitrogen oxides formed in after-blast fumes. The water-gel blasting agent comprises a continuous phase of inorganic oxidizer salt solution throughout which is dispersed a liquid or solid fuel(s) and gas bubbles or gas entraining agent for sensitization. The oxidizer salt solution preferably is thickened or gelled to render it viscous. To this water-gel is added the silicon powder in the same weight range as for the emulsion.

BACKGROUND

Emulsion and water-gel blasting agents are well-known in the art. They are fluid when formed (and can be designed to remain fluid at temperatures of use) and are used in both packaged and bulk forms. They commonly are mixed with ammonium nitrate prills and/or ANFO to form a "heavy ANFO" product, having higher energy and, depending on the ratios of components, better water resistance than ANFO. Such blasting agents normally are reduced in density by the addition of air voids in the form of hollow microspheres, other solid air entraining agents or gas bubbles, which materially sensitize the emulsion to detonation. A uniform, stable dispersion of the air entraining agent or gas bubbles is important to the detonation properties of the blasting agent. Gas bubbles, if present, normally are produced by the reaction of chemical gassing agents. Sensitization also can be obtained by incorporating porous AN or ANFO prills.

A problem associated with the use of blasting agents in mining blasting operations is the formation of nitrogen oxides, a yellow orange-colored smoke, in the gasses produced by the detonation of the blasting agent. These gasses will be referred to herein as "after-blast fumes." Not only is the formation of nitrogen oxides a problem from the standpoint that such fumes are toxic but also these fumes are visually and aesthetically undesirable due to their yellow/orange color. Many efforts have been made to eliminate or reduce the formation of such fumes. These efforts typically have been directed at improving the quality of the blasting agent and its ingredients to enhance the reactivity of the ingredients upon initiation. Other efforts have focused on improving blast pattern designs and initiation schemes. Still other efforts have focused on improving the borehole environment by dewatering or using a more water resistant emulsion blasting agent.

Typically, after-blast fumes are formed in soft or well-fractured rock and where water may be present in the boreholes. These conditions often are found in surface coal mining operations. Thus geological conditions that can influence the formation of after-blast fumes include soft rock formations; sand and mud seams; cracks, fissures and cavities; and borehole water.

Theoretically, after-blast fumes are caused when the gasses produced by the explosive reaction experience reduced pressures and temperatures, resulting in thermodynamically non-ideal gaseous reactions. Under more ideal reaction conditions, $N_2$ would be formed rather than NO and $NO_2$. In addition to geological conditions, other factors can influence or contribute to $NO_x$ formation (generated as the result of a non-ideal detonation reaction). Such factors include certain mining methods (long sleep times, deep boreholes, large patterns), blast design (delay sequence, pattern spacing, short crest burdens), blasting agent selection (water resistance, packaged versus bulk product, energy) and blasting agent formulation (oxygen balance, energy, sensitivity, ingredients). If a mine is experiencing frequent after-blast fumes, the method of the present invention will help to reduce such fumes.

Of these factors, the present invention deals primarily with the blasting agent formulation factor. The addition of silicon powder is found to reduce significantly the formation of after-blast $NO_x$ fumes in side-by-side comparative formulation testing, even when compared to aluminum powder. The silicon powder contributes energy to the blasting agent and apparently acts as a more effective reactant or scavenger of $NO_x$ than aluminum powder. In fact, silicon powder is as effective, or more so, than the use of urea as an additive for reducing $NO_x$ fumes, as is described in U.S. Pat. No. 5,608,185. Although silicon powder has been used, or suggested for use, in blasting agents as a metallic fuel, see, for example, U.S. Pat. Nos. 4,357,184 and 4,026,738, no mention is made of its use for purposes of reducing after-blast fumes.

Coal mining operations are facing increasing pressure from regulatory agencies and from local residents and communities to reduce after-blast fumes. Because of the various factors that can cause or contribute to after-blast fumes, the solution is not a simple or easy one. The present invention is a clear step toward a solution and one that provides a significant reduction in after-blast fumes, as is shown in the comparative examples presented below.

SUMMARY

The present invention is directed to an improved method of blasting whereby the formation of nitrogen oxide after-blast fumes is reduced. This helps satisfy the need for better fume characteristics in blasting. The method reduces the formation of nitrogen oxides in after-blast fumes resulting from the detonation of a blasting agent in a borehole. The method comprises formulating the blasting agent to contain from about 1% to about 20% silicon powder.

DETAILED DESCRIPTION

As indicated above the addition of silicon powder to a blasting agent significantly reduces the amount of nitrogen oxides formed in the detonation reaction between the oxidizer and fuel in the blasting agent. How the silicon powder performs this function is subject to hypotheses. Whether it reacts with the nitrogen oxides during the detonation reaction, acts as a scavenger of the nitrogen oxides after the reaction or functions in some other way is not clear.

The silicon powder used in the present invention typically is of a size range of −200 U.S. mesh. It is used in the amount of from about 1% to about 20% by weight of the blasting agent. The degree of effectiveness generally is proportional to the amount of silicon powder employed. However, for reasons of optimizing oxygen balance, energy and effectiveness, the preferred range is from about 2% to about 10%.

The blasting agents preferably are selected from three common types: ANFO, emulsions and water-gels. As previously described, ANFO typically is simply a blend of porous ammonium nitrate prills and fuel oil in a weight ratio of 94:6, respectively.

Emulsion Blasting Agents. In emulsions, the immiscible organic fuel forming the continuous phase of the composition is present in an amount of from about 3% to about 12%, and preferably in an amount of from about 3% to less than about 7% by weight of the composition, depending upon the amount of ANFO or AN prills used, if any. The actual amount of organic fuel used can be varied depending upon the particular immiscible fuel(s) used, upon the presence of other fuels, if any, and the amount of urea used. The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cotton seed oil, peanut oil, and soybean oil. Particularly preferred liquid fuels are mineral oil, No. 2 fuel oil, paraffin waxes, microcrystalline waxes, and mixtures thereof. Aliphatic and aromatic nitrocompounds and chlorinated hydrocarbons also can be used. Mixtures of any of the above can be used.

The emulsifiers for use in emulsions can be selected from those conventionally employed, and are used generally in an amount of from about 0.2% to about 5%. Typical emulsifiers include sorbitan fatty esters, glycol esters, substituted oxazolines, alkylamines or their salts, derivatives thereof and the like. More recently, certain polymeric emulsifiers, such as a bis-alkanolamine or bis-polyol derivative of a bis-carboxylated or anhydride derivatized olefinic or vinyl addition polymer, have been found to impart better stability to emulsions under certain conditions.

Optionally, and in addition to the immiscible liquid organic fuel and the silicon powder, other liquid or solid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to about 25% by weight.

The inorganic oxidizer salt solution forming the discontinuous phase of the emulsion generally comprises inorganic oxidizer salt, in an amount from about 45% to about 95% by weight of the emulsion, and water and/or water-miscible organic liquids, in an amount of from about 0% to about 30%, and preferably from about 9% to about 20%. The oxidizer salt preferably is primarily ammonium nitrate, but other salts may be used. The other oxidizer salts are selected from the group consisting of ammonium, alkali and alkaline earth metal nitrates, chlorates and perchlorates. Of these, sodium nitrate (SN) and calcium nitrate (CN) are preferred. Depending upon the amount of silicon powder used, solid oxidizer can be blended with the emulsion to optimize oxygen balance and hence energy. The solid oxidizers can be selected from the group above listed. Of the nitrate salts, ammonium nitrate prills are preferred. Preferably, from about 20% to about 50% solid ammonium nitrate prills (or ANFO) are used, although as much as 80% ANFO is possible.

Chemical gassing agents preferably comprise sodium nitrite, that reacts chemically in the emulsion to produce gas bubbles, and a gassing accelerator such as thiocyanate, to accelerate the decomposition process. A sodium nitrite/thiocyanate combination produces gas bubbles immediately upon addition of the nitrite to the oxidizer solution containing the thiocyanate, which solution preferably has a pH of about 5.5. The nitrite is added as a diluted aqueous solution in an amount of from less than 0.1% to about 0.4% by weight, and the accelerator is added in a similar amount to the oxidizer solution. In addition to or in lieu of chemical gassing agents, hollow spheres or particles made from glass, plastic or perlite may be added to provide density reduction.

The emulsion of the present invention may be formulated in a conventional manner. Typically, the oxidizer salt(s), urea and other aqueous soluble constituents first are dissolved in the water (or aqueous solution of water and miscible liquid fuel) at an elevated temperature or from about 25° C. to about 90° C. or higher, depending upon the crystallization temperature of the salt solution. The aqueous solution, which may contain a gassing accelerator, then is added to a solution of the emulsifier and the immiscible liquid organic fuel, which solutions preferably are at the same elevated temperature, and the resulting mixture is stirred with sufficient vigor to produce an emulsion of the aqueous solution in a continuous liquid hydrocarbon fuel phase. Usually this can be accomplished essentially instantaneously with rapid stirring. (The compositions also can be prepared by adding the liquid organic to the aqueous solution.) Stirring should be continued until the formulation is uniform. When gassing is desired, which can be immediately after the emulsion is formed or up to several months thereafter when it has cooled to ambient or lower temperatures, the gassing agent and other optional trace additives are added and mixed homogeneously throughout the emulsion to produce uniform gassing at the desired rate. The solid ingredients, if any, can be added along with the gassing agent and/or trace additives and stirred throughout the formulation by conventional means. Further handling should quickly follow the addition of the gassing agent, depending upon the gassing rate, to prevent loss or coalescence of gas bubbles. The formulation process also can be accomplished in a continuous manner as is known in the art.

It has been found to be advantageous to pre-dissolve the emulsifier in the liquid organic fuel prior to adding the organic fuel to the aqueous solution. This method allows the emulsion to form quickly and with minimum agitation. However, the emulsifier may be added separately as a third component if desired.

Water-gel Blasting Agents. In water-gels, the inorganic oxidizer salt solution forming the continuous phase of the blasting agent generally comprises inorganic oxidizer salt in an amount of from about 30% to about 90% by weight of the total composition and water and/or water-miscible organic liquids in an amount of from about 10% to about 40%.

The oxidizer salts are selected from the group consisting of ammonium, alkali and alkaline earth metal nitrates, chlorates and perchlorates. The preferred oxidizer salt is ammonium nitrate (AN), but calcium nitrate (CN) and sodium nitrate (SN) or other oxidizer salts can be used. The total solubilized oxidizer salt employed is preferably from about 50% to about 86%. As is described below, AN or ANFO prills additionally can be added to the compositions.

The total amount of water and/or water-miscible liquid present in the water-gel composition is generally from about 10 to about 40% by weight. The use of water and/or water-miscible liquid in amounts within this range generally will allow the compositions to be fluid enough to be pumped by conventional slurry pumps at formulation or mixing temperatures, i.e., above the crystallization temperature (fudge point) of the composition. After pumping, precipitation of some of the dissolved oxidizer salt may occur upon cooling to temperatures below the fudge point, although repumpable formulations may experience little, if any, precipitation.

The fuel can be solid and/or liquid. Examples of solid fuels which can be used are aluminum particles and carbonaceous materials such as gilsonite or coal. Of course the silicon powder also functions as a solid fuel. Liquid or soluble fuels may include either water-miscible or immiscible organics. Miscible liquid or soluble fuels include alcohols such as methyl alcohol, glycols such as ethylene glycol, amides such as formamide, urea, and analogous nitrogen containing liquids. As previously mentioned, urea also functions to reduce $NO_x$ in after-blast fumes. These fuels generally act as a solvent for the oxidizer salt or water extender and, therefore, can replace some or all of the water. Water-immiscible organic liquid fuels can be aliphatic, alicyclic, and/or aromatic and either saturated and/or unsaturated. For example, toluene and the xylenes can be employed. Aliphatic and aromatic nitro-compounds also can be used. Preferred fuels include mixtures of normally liquid hydrocarbons generally referred to as petroleum distillates such as gasoline, kerosene and diesel fuels. A particularly preferred liquid fuel is No. 2 fuel oil. Tall oil and paraffin oil also can be used. Mixtures of any of the above fuels can be used. As is described below, the water-immiscible organic liquid fuel can be combined with ammonium nitrate prills before it is added to the composition.

The fuel is present in an amount to provide an overall oxygen balance of from about −10 to about 0 percent (gm of oxygen per gm of blasting agent). Fuel oil, when used, is normally used in amounts of from about 1% to about 8% by weight, preferably from about 3% to about 7%, and when used as the sole fuel, is preferably used in amounts of from about 4% to about 6% by weight.

The aqueous fluid phase of the composition is rendered viscous by the addition of one or more thickening agents of the type and in the amount commonly employed in the art. Such thickening agents include galactomannin, preferably guar, gums; biopolymer gums; polyacrylamide and analogous synthetic thickeners; flours and starches. Thickening agents generally are used in amounts ranging from about 0.2% to about 2.0%, but flours and starches may be employed in much greater amounts, up to about 10% in which case they also function importantly as fuels. Mixtures of thickening agents can be used.

The thickening agent preferably is used in an amount sufficient to prethicken the aqueous solution to a viscosity of at least 500 centipoise (Brookfield viscometer, Model HATD, No. 2 HA spindle at 100 rpm) prior to the addition of the density reducing agent as described below.

As is well known in the art, density reducing agents are employed to lower and control the density of and to impart sensitivity to water-gel blasting agents. The compositions of the present invention preferably employ a small amount, e.g., about 0.01% to about 0.2% or more, of a chemical gassing agent. A preferred gassing agent is a nitrite salt such as sodium nitrite, which chemically reacts in the solution of the composition to produce gas bubbles. Other trace ingredients also can be added to enhance gassing rates or adjust pH. Mechanical agitation of the thickened aqueous phase of the composition, such as obtained during the mixing of the prethickened aqueous phase and the remaining ingredients, will result in the entrainment of fine air bubbles by mechanical means. Hollow particles such as hollow glass spheres, styrofoam beads, plastic microballoons and porous solids such as perlite also are commonly employed to produce a gassified explosive composition, particularly when incompressibility is desired. Two or more of these common density reducing means may be employed simultaneously.

A crosslinking agent preferably is employed in the water-gel compositions of the present invention. Crosslinking agents for crosslinking the thickening agents are well known in the art. Such agents usually are added in trace amounts and usually comprise metallic ions such as dichromate or antimony ions. The preferred crosslinking agent is antimony ion, preferably from potassium pyroantimonate, in an amount of from about 0.001% to about 0.1%.

To the basic composition described above, AN particles preferably are added in an amount of from about 10% to about 70% of the total composition. The form of such AN can be porous prills, dense prills or crystalline. If porous prills are used, the water-immiscible organic liquid fuel preferably can be added to the prills prior to adding the prills to the composition. This is the preferred manner of adding the water-immiscible organic liquid fuel to the composition, because when added separately it tends to fluidize the mixture and thus reduce its viscosity, thereby decreasing the ability of the aqueous phase to entrain air or hold gas bubbles.

The water-gel blasting agents are prepared by first forming a solution of the oxidizer salt and water (and miscible liquid fuel, if any) at a temperature above the fudge point or crystallization temperature of the solution. Typically, the explosives are prepared at a temperature of at least 10° C. above the fudge point. The thickening agent then is added to prethicken the solution to a desired degree, preferably to a viscosity of at least 500 centipoise (Brookfield viscometer). The density reducing agent then is added and dispersed throughout the prethickened solution to form a fine, stable dispersion of air, gas bubbles, or hollow particles in a volume sufficient to reduce the density to the desired level. A crosslinking agent preferably then is added to crosslink the thickened solution and impart final desired rheology. Optionally, ammonium nitrate particles (which preferably contain water-immiscible organic liquid fuel) may be added to the prethickened solution and dispersed uniformly throughout the composition. Conventional metering, blending and mixing apparatus can be employed in the above steps, which can be performed in a continuous or batch process.

EXAMPLES

The following examples further illustrate the invention.

Example 1

The formulations set forth below were loaded into a 4-inch by 14-inch schedule 40 steel pipe and detonated in a detonation chamber. Mix 3, which contained silicon powder, had the lowest production of $NO_x$ in parts per million.

| | Mix 1 | Mix 2 | Mix 3 |
|---|---|---|---|
| Emulsion[1] (%) | 50 | 50 | 50 |
| ANFO (%) | 50 | 45 | 46.2 |
| Aluminum powder (%) | — | 5 | — |
| Silicon powder (%) | — | — | 3.8 |
| $NO_x$ ($NO_2$ + NO) (ppm) | 349 | 145 | 142 |

[1]Emulsion:

| AN | Water | Emulsifier | Mineral Oil | Fuel Oil | Plastic Microballoons |
|---|---|---|---|---|---|
| 77.5 | 15.9 | 1.5 | 2.25 | 2.25 | 0.6 |

$NO_x$ data are averages of two shots for each mix. $NO_x$ was measured with a Draeger Multiwarn-II gas monitor with XS electrochemical sensors for $NO_2$ and NO.

Example 2

The formulations set forth below were loaded into an 8-inch by 48-inch schedule 40 PVC pipe and detonated underwater. The visible $NO_2$ fumes were observed and compared. The mix containing the silicon powder had the best fume results.

| | Mix 1 | Mix 2 | Mix 3 |
|---|---|---|---|
| Emulsion[1] (%) | 49 | 49 | 49 |
| ANFO (%) | 49 | 44 | 44 |
| Glass Microballoons (%) | 2 | 2 | 2 |
| Aluminum powder (%) | — | 5 | — |
| Silicon powder (%) | — | — | 5 |
| $NO_2$ rating[2] | 6.7 | 4.3 | 3.5 |

[1]Emulsion:

| AN | Water | Emulsifier | Mineral Oil |
|---|---|---|---|
| 76.1 | 17.9 | 0.9 | 5.1 |

[2]$NO_2$ visual rating scale of 0 to 9, with 0 being colorless and 9 being deep red. $NO_2$ data are averages of three shots each for mixes 1 and 2, and four shots for mix 3.

Example 3

The formulations set forth below were loaded into an 8-inch by 48-inch schedule 40 PVC pipe and detonated underwater. No visible $NO_2$ fumes were observed in an emulsion matrix with different amounts of silicon powder (Mixes 1 and 2), an ANFO mix (Mix 3) and a water-gel matrix (Mix 4).

| | Mix 1 | Mix 2 | Mix 3 | Mix 4 |
|---|---|---|---|---|
| Emulsion[1] (%) | 95 | 80 | — | — |
| ANFO (%) | — | — | 95 | — |
| Water-gel[2] (%) | — | — | — | 95 |
| Silicon powder (%) | 5 | 20 | 5 | 5 |
| $NO_2$ rating[4] | 0 | 0 | 0 | 0 |

$NO_2$ data are averages of three shots for each mix.

[1]Emulsion:

| AN | CN | Water | Emulsifier | Mineral Oil | Fuel Oil | Microballoons |
|---|---|---|---|---|---|---|
| 61.7 | 13.6 | 15.6 | 1.0 | 2.4 | 2.4 | 3.3 |

[2]Water Gel:

| Solution[3] | Dry AN |
|---|---|
| 40 | 60 |

[3]Water-gel solution: 35% AN, 10% $Na(ClO_4)$, 33% amine nitrate, 18% water, 1% gum, 3% glycol.

[4]$NO_2$ visual rating scale of 0 to 9, with 0 being colorless and 9 being deep red.

While the present invention has been described with reference to certain illustrative examples and preferred embodiments, various modifications will be apparent to those skilled in the art and any such modifications are intended to be within the scope of the invention as set forth in the appended claims.

What is claimed is:

1. A method of reducing the formation of nitrogen oxides in after-blast fumes resulting from the detonation of a blasting agent in a borehole located in a geological condition that is susceptible to the formation of such nitrogen oxides, which method comprises formulating the blasting agent to comprise ammonium nitrate inorganic oxidizer salt, organic fuel and from about 1% to about 20% silicon powder, loading the blasting agent into the borehole and then detonating the blasting agent.

2. A method according to claim 1 wherein the blasting agent additionally contains water.

3. A method according to claim 2 wherein the blasting agent additionally contains a water-miscible liquid.

4. A method according to claim 1 wherein the geological condition includes soft rock formations, sand and mud seams, cracks, fissures, cavities and borehole water.

5. A method according to claim 1 wherein the blasting agent is an emulsion blasting agent having an emulsifier; an organic fuel forming a continuous phase; and a discontinuous oxidizer salt solution phase that comprises the ammonium nitrate inorganic oxidizer salt, water or a water-miscible liquid and silicon powder present in an amount of from about 1% to about 20% by weight of the agent.

6. A method according to claim 5 wherein the emulsion blasting agent further comprises from about 20% to about 50% ammonium nitrate prills.

7. A method according to claim 5 wherein the emulsion blasting agent further comprises up to about 80% ANFO.

8. A method according to claim 6 wherein the organic fuel is present in an amount of less than about 7% by weight of the agent.

9. A method according to claim 6 wherein the emulsion blasting agent contains an additional oxidizer salt or salts selected from the group consisting of sodium nitrate and calcium nitrate.

* * * * *